US007406283B2

(12) United States Patent
Noguchi et al.

(10) Patent No.: US 7,406,283 B2
(45) Date of Patent: Jul. 29, 2008

(54) DESKTOP COLOR IMAGE FORMING APPARATUS AND METHOD OF MAKING THE SAME

(75) Inventors: Yuusuke Noguchi, Kanagawa-ken (JP); Hiromichi Ema, Tokyo (JP); Hiroshi Ishii, Kanagawa-ken (JP); Yutaka Fukuchi, Kanagawa-ken (JP); Kazuosa Kuma, Kanagawa-ken (JP); Kazuki Suzuki, Saitama-ken (JP); Makoto Kikura, Kanagawa-ken (JP); Masumi Sato, Kanagawa-ken (JP); Hiroyasu Shijo, Tokyo (JP); Tomotoshi Nakahara, Kanagawa-ken (JP); Motokazu Yasui, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/770,255

(22) Filed: Jun. 28, 2007

(65) Prior Publication Data

US 2007/0242976 A1 Oct. 18, 2007

Related U.S. Application Data

(60) Division of application No. 11/087,694, filed on Mar. 24, 2005, now Pat. No. 7,263,309, which is a continuation of application No. 10/660,571, filed on Sep. 12, 2003, now Pat. No. 6,898,407.

(30) Foreign Application Priority Data

Sep. 12, 2002 (JP) ..... 2002-266629

(51) Int. Cl.
*G03G 15/01* (2006.01)

(52) U.S. Cl. ..... 399/302; 399/308

(58) Field of Classification Search ..... 399/107, 399/297, 298, 299, 302, 306, 308
See application file for complete search history.

(56) References Cited

U.S. PATENT DOCUMENTS

| | | | |
|---|---|---|---|
| 5,210,573 | A | 5/1993 | Fukuchi et al. |
| 5,508,789 | A | 4/1996 | Castelli et al. |
| 6,324,374 | B1 | 11/2001 | Sasamoto et al. |

(Continued)

FOREIGN PATENT DOCUMENTS

| | | |
|---|---|---|
| EP | 1 098 228 | 5/2001 |

(Continued)

*Primary Examiner*—Hoan H Tran
(74) *Attorney, Agent, or Firm*—Oblon, Spivak, McClelland, Maier & Neustadt, P.C.

(57) ABSTRACT

The present invention relates to an electrophotographic color image forming apparatus using a tandem-drum development, an indirect image-transfer method, and a vertical sheet supply path. An intermediate image-transfer member is angled relative to a horizontal line such that a rear side of the intermediate image-transfer member away from a recording sheet is lifted and a front side of the intermediate image-transfer member closer to the recording sheet is lowered. Further, image creating mechanisms of the tandem-drum development are aligned and arranged in parallel to a moving image transfer bed of the intermediate image-transfer member, such that one of the image creating mechanisms firstly forming an image faces the rear side of the moving image transfer bed and another one of the image creating mechanisms lastly forming an image faces the front side.

9 Claims, 17 Drawing Sheets

U.S. PATENT DOCUMENTS

| | | | | |
|---|---|---|---|---|
| 6,470,161 | B2 | 10/2002 | Fujishiro et al. | |
| 6,493,532 | B2 | 12/2002 | Nakahara et al. | |
| 6,501,913 | B2 | 12/2002 | Hattori et al. | |
| 6,507,720 | B2 | 1/2003 | Kabumoto et al. | |
| 6,546,219 | B2 | 4/2003 | Sato et al. | |
| 6,567,643 | B2 | 5/2003 | Yasui et al. | |
| 6,591,077 | B2 | 7/2003 | Yanagisawa et al. | |
| 6,628,908 | B2 | 9/2003 | Matsumoto et al. | |
| 6,628,916 | B2 | 9/2003 | Yasui et al. | |
| 6,636,709 | B2 | 10/2003 | Furukawa et al. | |
| 6,647,223 | B2 | 11/2003 | Ishii | |
| 6,647,233 | B2 | 11/2003 | Hiroki | |
| 6,907,215 | B2 * | 6/2005 | Yasukawa et al. | 399/281 |
| 7,020,415 | B2 | 3/2006 | Abe | |
| 2001/0055499 | A1 | 12/2001 | Sato | |
| 2002/0080219 | A1 | 6/2002 | Yamaguchi et al. | |
| 2003/0235440 | A1 | 12/2003 | Takada | |
| 2004/0228664 | A1 | 11/2004 | Yamada | |

FOREIGN PATENT DOCUMENTS

| | | | |
|---|---|---|---|
| EP | 1 202 131 | A2 | 5/2002 |
| EP | 1 376 257 | A2 | 1/2004 |
| JP | 11-95519 | | 4/1999 |
| JP | 2000-264492 | | 9/2000 |
| JP | 2001-100488 | | 4/2001 |
| JP | 2001-265096 | | 9/2001 |
| JP | 2002-166593 | | 6/2002 |
| JP | 2002-214868 | | 7/2002 |
| JP | 2002-214974 | | 7/2002 |
| JP | 2004-53818 | | 2/2004 |

* cited by examiner

DESKTOP COLOR IMAGE FORMING APPARATUS AND METHOD OF MAKING THE SAME

CROSS REFERENCE TO RELATED APPLICATIONS

This application is a divisional Application of, and claims the benefit of priority under 35 U.S.C. § 120 from, U.S. application Ser. No. 11/087,694, filed Mar. 24, 2005, now U.S. Pat. No. 7,263,309, which is a Continuation Application of U.S. application Ser. No. 10/660,571, filed Sep. 12, 2003, now U.S. Pat. No. 6,898,407, issued May 24, 2005, which claims the benefit of priority under 35 U.S.C. § 119 from Japanese Patent Application No. 2002-266629, filed Sep. 12, 2002. The entire contents of each of the above applications are incorporated herein by reference.

BACKGROUND OF THE INVENTION

1. Field of the Invention

The present invention relates to a color image forming apparatus, and more particularly to a color image forming apparatus realized in a compact desktop size by reducing a total height while securing a sufficient length necessary for a sheet path between an image transfer point and an image fixing point. Also, the present invention relates to a method of making the above-mentioned color image forming apparatus.

2. Discussion of the Background

In recent years, an electrophotographic image forming apparatus has been increasingly demanded in a full-color version, such as a color printer, a color copying machine, and so forth. In response, quite a large number of full-color image forming apparatuses have been introduced to the market. In comparison with a monochrome image forming apparatus, a full-color image forming apparatus inevitably has larger dimensions, due to its structure, and achieves a relatively lower performance in image forming, e.g., a lower image forming speed. However, there is also a great demand for the full-color image forming apparatus to have a compact size, such as the monochrome printer, capable of being placed on a desk and to be able to perform at a relatively high image forming speed.

In the full-color image forming apparatus, there are two adoptable color recording methods; a single drum type and a tandem drum type. The single-drum-type image forming apparatus has a typical configuration in which a plurality of development units are arranged around a single photosensitive drum. The development units contain different color toners and sequentially transfer the color toners to the surface of the photosensitive drum so as to form a composite color image. The composite color image is then transferred onto a recording sheet. On the other hand, the tandem-drum-type image forming apparatus has a plurality of photosensitive drums arranged in line and forms single-color toner images with different color toners on the corresponding photosensitive drums. Then, the single-color toner images are sequentially transferred onto a recording sheet so as to form a composite color toner image.

The single-drum type has advantages in size and cost, in comparison with the tandem-drum type, but also has difficulty in enhancing the image forming speed due to the need to repeat image forming, which is normally repeated four times. On the contrary, the tandem-type has disadvantages in size and cost, but has an advantage in the enhancement of the image forming speed.

Under the aforementioned circumstances, increasing attention has been focused on full-color image forming apparatus based on the tandem drum type, to attain high speed image forming like the monochrome printer.

There are two different types of tandem-drum image forming apparatuses, as shown in FIGS. 1 and 2. In the tandem-drum image forming apparatus shown in FIG. 1, images formed on four photosensitive drums 51, arranged in line, are sequentially transferred by corresponding image transfer units 52 onto a recording sheet, which is conveyed from a sheet supply unit 60 to an image fixing unit 61 by a sheet conveying belt 53. This method is referred to as a direct image transfer method. In the tandem-drum image forming apparatus shown in FIG. 2, in which components equivalent to those shown in FIG. 1 are given the same numeral references, images formed on the four photosensitive drums 51, arranged in line, are sequentially transferred by corresponding primary image transfer units 52 to form a composite color image onto an intermediate transfer belt 54. Then, the composite color image carried by the intermediate transfer belt 54 is transferred by a secondary image transfer unit 55 onto a recording sheet, which is conveyed from a sheet supply unit 60 to an image fixing unit 61 by a sheet conveying belt 53. This method is referred to as an indirect image transfer method.

In the tandem-drum-type image forming apparatus of FIG. 1, which adopts the direct image transfer method, the sheet supply unit 60 and the image fixing unit 61 need to be arranged upstream and downstream, respectively, in a sheet conveying direction relative to the four-tandem-drum mechanism. Therefore, the apparatus using the direct image transfer method is inevitably upsized in the sheet conveying direction, which is a drawback of this type of apparatus. On the contrary, in the image forming apparatus of FIG. 2, which adopts the indirect image transfer method, the secondary image transfer unit 55 can be positioned rather freely and, thus, a transfer path for the recording sheet can be shortened. Therefore, it is possible to reduce the size of the apparatus by using the indirect image transfer method.

From the above explanation, a full-color image forming apparatus preferably has the tandem-drum-type from the viewpoint of high speed, and preferably adopts the indirect image transfer method from the viewpoint of downsizing.

In the full-color image forming apparatus using the tandem-drum mechanism and the indirect image transfer method, a vertically-extended sheet transfer mechanism can be employed to minimize a sheet travel distance, along the sheet transfer path, from a sheet inlet of the sheet supply unit to the fixing unit. In this instance, the speed of image forming can be enhanced by reducing the amount of the sheet travel distance. Further, with this structure, the occurrence of a deficiency such as a sheet jamming may be suppressed. In such an apparatus using the vertically-extended sheet transfer mechanism, the second image transfer unit 55 is necessarily positioned next to one end of the intermediate transfer belt 54 (e.g., next to the right of the intermediate transfer belt 54), as shown in FIG. 3.

In this instance, if four image forming mechanisms 50 including the photosensitive drums 51*a* are arranged in line on and along the upper running surface of the intermediate transfer belt 54, an overlaid composite color image is created on the intermediate transfer belt 54 when a black color toner (Bk) is transferred onto the intermediate transfer belt 54. The black color toner (Bk) is the last toner transferred in the image forming sequence and, therefore, the overlaid composite color image is brought close to the secondary image transfer unit 55 only after a half turn of the intermediate transfer belt 54. This makes the first copy time relatively long. The first copy time is one of the speed indicators for image forming apparatuses, and indicates a speed for copying a first page.

To improve the first copy time in the above-mentioned image forming apparatus, the four image forming mechanisms 50 are arranged on and along the lower running surface of the intermediate transfer belt 54, instead of on and along the upper running surface thereof, as shown in FIG. 4. FIG. 5 is a top view of the image forming apparatus of FIG. 4. With this structure, the length of the sheet transfer path is minimized and the first copy time is improved, since the overlaid composite color can be brought close to the secondary image transfer unit 54 immediately after the transfer of the black color toner (Bk) is completed.

As described above, based on the presently available techniques, a desk-top and high speed full-color image forming apparatus may be realized, most preferably by using the tandem-drum image forming mechanism, the indirect image transfer method, and the vertical sheet conveying path.

It should be noted that in an electrophotographic image forming apparatus, the sheet conveying path between the image transfer point and the fixing point needs to have a distance to a certain extent determined by the size of the sheets applied or the like. The reason for this is explained with reference to FIG. 6.

In FIG. 6, the secondary image transfer unit 55 has a line speed b and the fixing unit 61 has a line speed a. Ideally, the line speeds a and b would be equal to each other. However, making the line speeds a and b equal to each other is not practical, in general, due to manufacturing tolerances, even if they are designed to be equal to each other. When the line speed b of the image transfer is slower than the line speed a of the image fixing, the leading edge of the recording sheet may reach the fixing unit 61 before the rear part of the recording sheet passes by the image transfer unit 55, depending upon the size of the recording sheet.

In this case, the recording sheet under the image transfer process is forcibly pulled forward by the fixing unit 61 and, as a result, image displacement is caused. To avoid this, the line speed b is generally designed to be faster than the line speed a. However, when the line speed b is faster than the line speed a, the recording sheet may have slack or a bend that causes the toner image on the recording sheet to contact a part of the machine. As a result, the toner image on the recording sheet is disturbed.

Therefore, the sheet passage between the image transfer unit 55 and the fixing unit 61 should have a length h that can accommodate slack or a bend of the recording sheet. Based on this structure, a vertical distance (i.e., a height h sin β; see FIG. 7) from the image transfer point to the fixing point is determined to avoid the above-mentioned image displacement problem by satisfying relationships $a \leqq b$, $(b-a) \times c/b = 1$, and $Bmax \leqq BBmax$. In these relationships, a is the line speed of the fixing rollers, b is the line speed of the image transfer rollers, c is the length of the recording sheet in the sub-scanning direction, Bmax is a maximum amount of a slack or a bend of the recording sheet caused between the image transfer point to the fixing point, and Bbmax is a maximum permissible amount of a slack or a bend of the recording sheet caused between the image transfer point to the fixing point.

In a full color image forming apparatus employing tandem-drum-type image forming and indirect image transfer, as well as a vertical sheet conveying path, it is considerably difficult to decrease the total height of such apparatus while securing a reasonably sufficient distance between the image transfer point and the fixing point. If the full color image forming apparatus is a desk-top machine, it is generally required to have a smaller profile in every dimension. However, the most critical dimension is the height, since it directly affects the ability of the user to access the recording sheets in the ejection tray, to remove the jammed sheets, to exchange the toner cartridge, and so forth. The difficulty lies in the relationship between securing the certain distance between the image transfer point and the fixing point, and in reducing the machine height, which are contradictory objectives.

SUMMARY OF THE INVENTION

In view of the foregoing, it is an object of the present invention to provide a novel color image forming apparatus which realizes a compact desktop profile while securing a sufficient length between a secondary image-transfer point and a fixing point.

Another object of the present invention is to provide a novel method of making a color image forming apparatus which realizes a compact desktop profile while securing a sufficient length between a secondary image-transfer point and a fixing point.

To achieve the above-mentioned objects and other objects, in one example, the present invention provides a novel color image forming apparatus including an image generating mechanism and a sheet supply mechanism. The image generating mechanism includes an image forming mechanism, an optical writing mechanism, an intermediate image-transfer member, a fixing mechanism, a sheet ejecting mechanism, a toner container, and an electric circuit. The image forming mechanism forms an image and includes a plurality of image creating mechanisms, each of which forms an image and includes a photosensitive member. The optical writing mechanism optically writes an image on the photosensitive member of each of the plurality of image creating mechanisms. The intermediate image-transfer member has an image transfer bed, moving in a predetermined direction in a lower part of the intermediate image-transfer member, to receive a plurality of the images from the respective photosensitive members, such that the plurality of the images are sequentially overlaid to form a multi-overlaid image.

The fixing mechanism fixes the multi-overlaid image on a recording sheet. The sheet ejecting mechanism ejects the recording sheet having the fixed multi-overlaid image thereon. The container replenishes toner to the image forming mechanism. The electric circuit includes a plurality of circuit blocks and supplies power and necessary signals to the apparatus. The sheet supply mechanism supplies recording sheets through a sheet inlet thereof to the image generating mechanism. In this apparatus, the intermediate image-transfer member is arranged with a predetermined angle relative to a horizontal line, such that a rear side of the intermediate image-transfer member away from the recording sheet is lifted and a front side of the intermediate image-transfer member closer to the recording sheet is lowered.

Further, the plurality of image creating mechanisms are aligned in parallel and are arranged along and parallel to the image transfer bed of the intermediate image-transfer member, such that one of the plurality of image creating mechanisms firstly forming an image faces the rear side of the image transfer bed and another one of the plurality of image creating mechanisms lastly forming an image faces the front side of the image transfer bed.

The present invention also provides a novel method of making a color image forming apparatus.

BRIEF DESCRIPTION OF THE DRAWINGS

A more complete appreciation of the disclosure and many of the attendant advantages thereof will be readily obtained as the same becomes better understood by reference to the following detailed description, when considered in connection with the accompanying drawings, wherein.

DETAILED DESCRIPTION OF PREFERRED EMBODIMENTS

Figure 1:
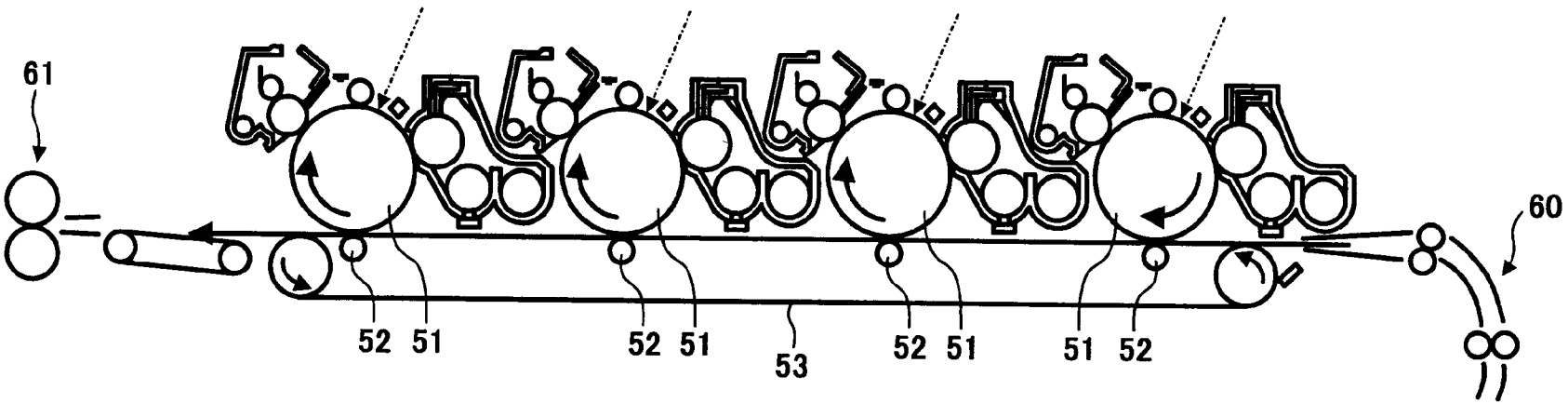
FIG. 1 PRIOR ART
FIG. 1 is a schematic diagram of a background color image forming apparatus with a direct-transfer method and a tandem image forming mechanisms.
Figure 2:
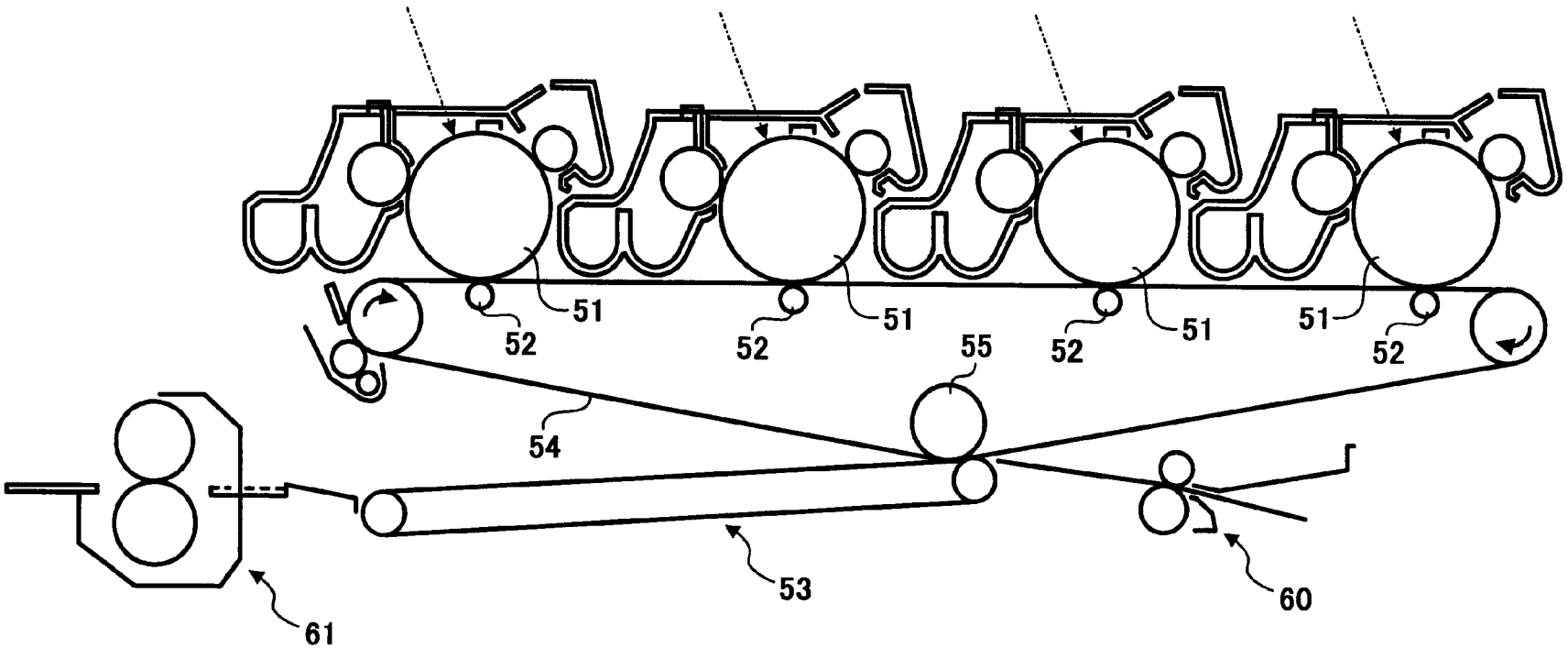
FIG. 2 PRIOR ART
FIG. 2 is a schematic diagram of a background color image forming apparatus with an indirect-transfer method and the tandem image forming mechanisms.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 7, a description is made for a color laser printer 100 as one example of a color image forming apparatus according to a preferred embodiment of the present invention.

Figure 7:
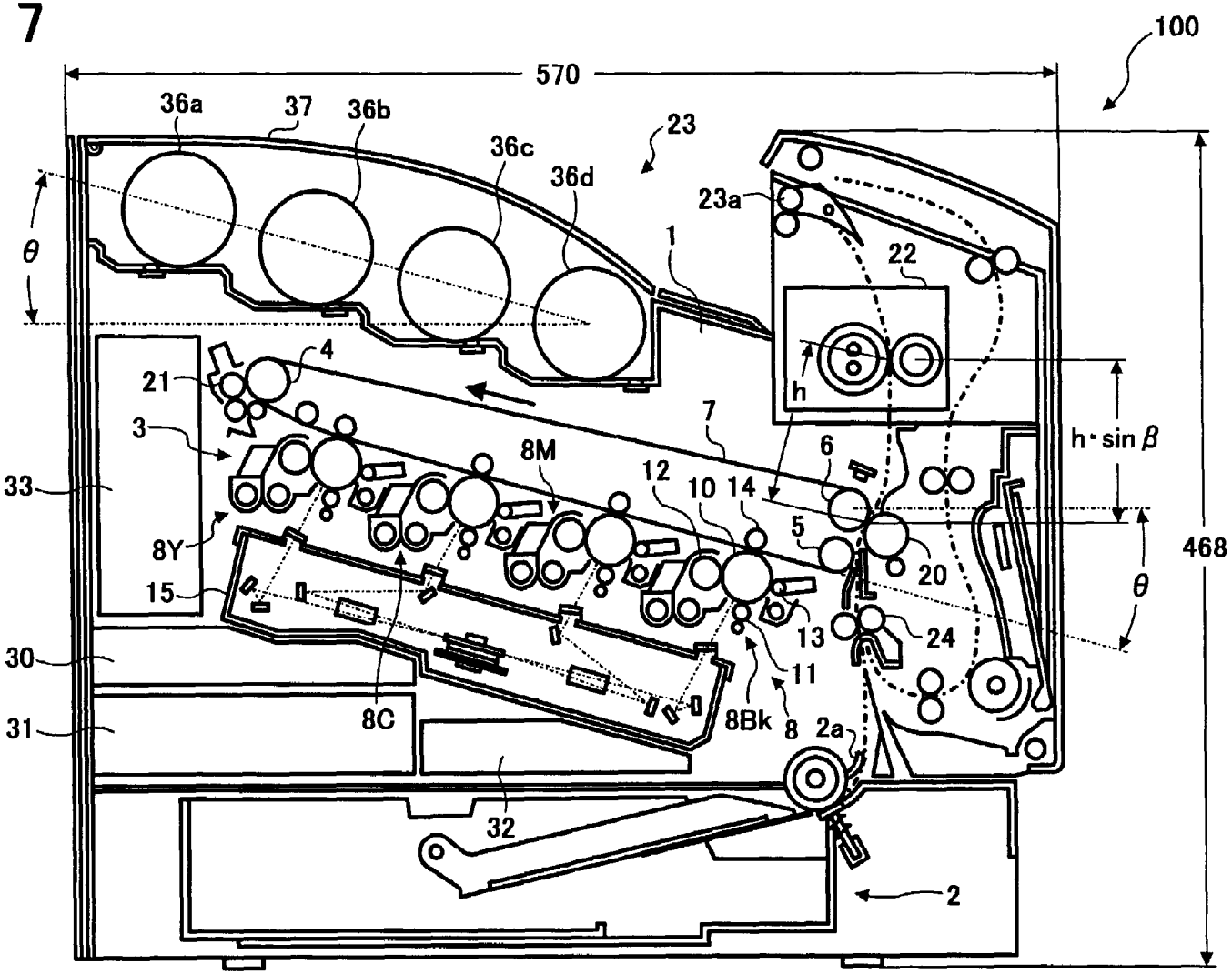
FIG. 7 is a schematic diagram of a color laser printer as one example of a color image forming apparatus according to a preferred embodiment of the present invention.

As shown in FIG. 7, the color laser printer 100 is provided with a main body 1 and a sheet supply mechanism 2 mounted under the main body 1. The main body 1 includes an image forming station 3 mounted over the sheet supply mechanism 2. In the image forming station 3, an intermediate transfer belt 7 including an endless belt and serving as an image carrying member is extended under pressure between a plurality of rollers 4, 5, and 6. A portion of the intermediate transfer belt 7 between the rollers 4 and 5 corresponds a lower side of the intermediate transfer belt 7 and forms a moving image forming bed. An image forming unit 8 which includes four image forming mechanisms 8Y, 8C, 8M, and 8Bk are mounted to face this moving image forming bed.

Each of the four image forming mechanisms 8Y, 8C, 8M, and 8Bk includes a photosensitive drum 10 serving as a latent image carrying member brought in contact with the intermediate transfer belt 7. Each image forming mechanism further includes a charging unit 11, a development unit 12, a cleaning unit 13, which are arranged around the photosensitive drum 10, and a transfer unit 14. The transfer unit 14 serves as a primary transfer mechanism and is arranged inside the intermediate transfer belt 7 at a position where the photosensitive drum 10 contacts the intermediate transfer belt 7.

In this example, the four image forming mechanisms 8Y, 8C, 8M, and 8Bk have an identical structure, but colors of development agents contained in their development units 12 are separated into yellow, cyan, magenta, and black colors per the development unit 12. Under the four image forming mechanisms 8Y, 8C, 8M, and 8Bk, an optical writing unit 15 is arranged. The optical writing unit 15 generates a light-modulated laser beam to irradiate the surface of the photosensitive drum 10 between the charging unit 11 and the development unit 12. In this example, the optical writing unit 15 is a single unit shared by the four image forming mechanisms 8Y, 8C, 8M, and 8Bk so as to gain a cost benefit. As an alternative, it is also possible to provide four independent optical writing units for the four image forming mechanisms 8Y, 8C, 8M, and 8Bk.

When an image forming operation is started, the photosensitive drums 10 of the four image forming mechanisms 8Y, 8C, 8M, and 8Bk are clockwise rotated by a driving mechanism (not shown) and the surfaces of the photosensitive drums 10 are charged evenly at a predetermined polarity. The charged surfaces are irradiated by the laser beams emitted from the optical writing unit 15, so that electrostatic latent images are formed on the surfaces of the photosensitive drums 10. In this process, the laser beams respectively transfer image information onto the surfaces of the photosensitive drums 10 for the above-mentioned electrostatic latent images. The image information is of four kinds of single color image information obtained by separating a desired full-color image into information of yellow, cyan, magenta, and black colors. When each of the thus-formed electrostatic latent images passes by the corresponding development unit 12, the latent image is developed by the development agent contained in the development unit 12 into a visual corresponding toner image.

One of the rollers 4, 5, and 6 of the intermediate transfer belt 7 is counterclockwise rotated by a driving mechanism (not shown) and the intermediate transfer belt 7 is moved in a direction indicated by an arrow. The remaining rollers follow the rotation. The moving intermediate transfer belt 7 receives thereon a yellow toner image formed by the image forming mechanism 8Y having the development unit 12 for the yellow color and transferred by the transfer unit 14. Subsequently, a cyan toner image, formed by the image forming mechanism 8C having the development unit 12 for the cyan color and transferred by the transfer unit 14, is superimposed onto the yellow toner image. Likewise, magenta and black toner images formed by the image forming mechanisms 8M and 8Bk, respectively, having the development units 12 for the magenta and black colors, respectively, and transferred by the corresponding transfer units 14, are sequentially superimposed onto the toner image made of the yellow and cyan colors. Consequently, a full color toner image made of the yellow, cyan, magenta, and black colors is formed on the surface of the moving intermediate transfer belt 7.

A secondary transfer unit 20 is arranged to face the roller 6 relative to the intermediate transfer belt 7, and a belt cleaning unit 21 for cleaning the surface of the intermediate transfer belt 7 is arranged to face the roller 4 relative to the intermediate transfer belt 7.

The residual toner remaining on the surface of the photosensitive drum 10 after the toner image transfer process is removed by the cleaning unit 13 from the surface of the photosensitive drum 10. Subsequently, the surface of the photosensitive drum 10 is discharged by a discharging mechanism (not shown), so that a surface potential of the photosensitive drum 10 is initialized as a preparation for the next image forming operation.

During the above-described operations, a recording sheet made of paper or a plastic resin is supplied from the sheet supply mechanism 2 to the image forming station 3 through a sheet inlet 2*a* of the sheet supply mechanism 2. The recording sheet inserted into the image forming station 3 is conveyed to a secondary transfer point formed between the secondary transfer unit 20 and the roller 6, via a pair of registration rollers 24. At this time, the secondary transfer unit 20 is applied by a transfer voltage having a reverse polarity relative to the charge polarity of the toner image formed on surface of the intermediate transfer belt 7, so that the full color toner image on the intermediate transfer belt 7 is transferred onto the recording sheet.

The recording sheet receiving the full color image is further conveyed to a fixing unit 22. The toner is then melted and fixed by heat and pressure to the recording sheet by the fixing unit 22. Then, the recording sheet with the fixed toner image is ejected to an output tray 23 through a pair of ejection rollers 23*a*. The surface of the intermediate transfer belt 7 is cleaned off by the belt cleaning unit 21 so that the residual toner remaining on the intermediate transfer belt 7 is removed therefrom after the secondary toner image transfer operation.

The above-described operation is the one in which a full color image is formed on the recording sheet using the four image forming mechanisms 8Y, 8C, 8M, and 8Bk. As an alternative, it is also possible to form a single color image or two- or three-colored image selectively using the four image forming mechanisms 8Y, 8C, 8M, and 8Bk.

Figure 3:
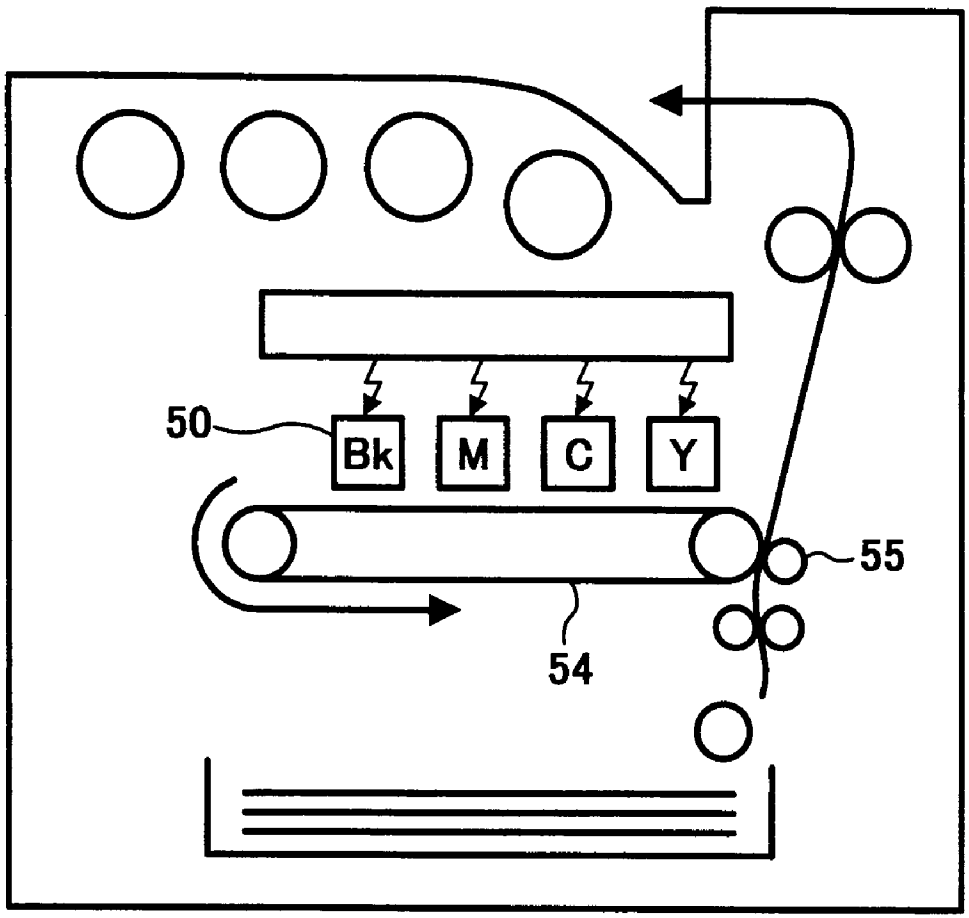
FIG. 3 PRIOR ART
FIG. 3 is a schematic diagram showing another view of the background color image forming apparatus of FIG. 2.

The color laser printer 100 having, as shown in FIG. 7, the above-described structure to provide the four development units for the respective colors, is capable of executing the image forming operation in a time period significantly shorter than a printer having a single development unit which contains the four color toners and uses them one by one. The color laser printer 100 of FIG. 7 has a further advantage of a first print faster than even the tandem-type image forming apparatus of FIG. 3, in which the image forming mechanism is arranged above the moving intermediate transfer belt.

It should be noted that in the color laser printer 100, the moving image forming bed of the intermediate transfer belt 7 formed between the rollers 4 and 5 is tilted with a predetermined angle θ relative to the horizontal line, and the four image forming mechanisms 8Y, 8C, 8M, and 8Bk are arranged in parallel to the moving image forming bed. The slant of the moving image forming bed is made to the right in the drawing, that is, the image forming mechanism located at a more downstream position in the moving direction of the intermediate transfer belt 7 is at a lower horizontal level.

Figure 4:
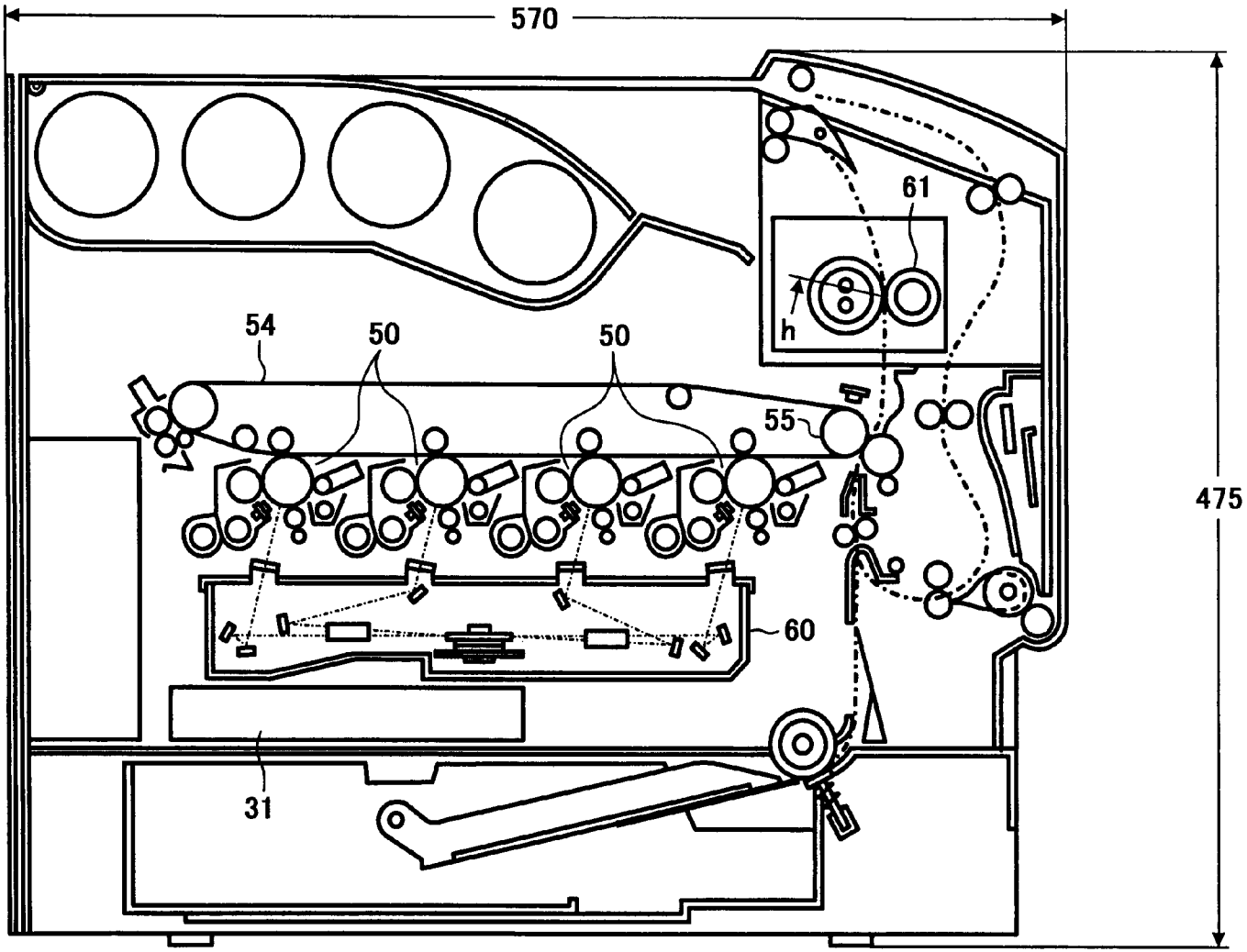
FIG. 4 PRIOR ART
FIG. 4 is a schematic diagram of an improved version of the background color image forming apparatus of FIG. 2.

The color laser printer 100 of FIG. 7 has a structure similar to that of the image forming apparatus of FIG. 4, but has a reduced height. As a result, the path between the sheet supply unit 2 and the fixing unit 22 is shorter. However, even with such a shorter path between the sheet supply unit 2 and the fixing unit 22, a requisite distance h between the secondary transfer unit 20 to the fixing unit 22 is securely obtained while the color laser printer 100 maintains a reduced height, by the arrangement of tilting the intermediate transfer belt 7.

If the moving image forming bed of the intermediate transfer belt 7 is horizontally arranged in a way as shown in FIG. 4, the entire intermediate transfer belt 7 needs to be set at an even horizontal level. In comparison with this, the color laser printer 100 of FIG. 7 has the intermediate transfer belt 7 slanted to the right with the predetermined angle θ relative to the horizontal line and, accordingly, a relatively large space having an approximately-triangular cross section is made at the left bottom of the main body. This space is illustrated as a hatched space in FIG. 8. When the length of the optical writing unit 15 is A, the hatched cross sectional triangle becomes an approximately-right-angled triangle having a height of Asinθ and a bottom of Acosθ. This triangular space is large enough to accommodate electrical components, and when the electrical components are arranged in the triangular space, the color laser printer 100 can be downsized both in height and length. As indicated in FIG. 7, the color laser printer 100 has a height of 468 mm and a length of 570 mm.

The above-mentioned electrical components of the color laser printer 100 include a high voltage power supply unit 30, a control unit 31, and an engine controller 33. The high voltage power supply unit 30 supplies a high voltage power required by the above-described image forming processes. The control unit 31 controls the conversion of image signals sent from a host computer into internal control signals. The engine controller 32 controls the entire operations of the color laser printer 100. Thus, in the color laser printer 100, most of the electrical components are arranged underneath the optical writing unit 15 and, therefore, the downsizing of the color laser printer 100 is achieved. Amongst the electrical components, a power supply unit 33 is vertically arranged at the back of the main body.

In the color laser printer 100, four toner cartridges 36*a*, 36*b*, 36*c*, and 36*d* having a cylindrical shape contain the yellow (M), cyan (C), magenta (M), and black (Bk) color toners, respectively. The four toner cartridges 36*a*, 36*b*, 36*c*, and 36*d* are arranged in this order in parallel to each other, along a line having the angle θ relative to the horizontal line, that is, parallel to the moving image forming bed, as illustrated in FIG. 7, to supply the Y, C, M, and Bk color toners to the four image forming mechanisms 8Y, 8C, 8M, and 8Bk, respectively. In this structure, the toner cartridge 36*a* for the Y color toner is located at the highest position in the vertical direction. Likewise, the toner cartridge 36*b* for the C color toner is located at the second highest position, the toner cartridge 36*c* at the third highest position, and the toner cartridge 36*d* at the lowest position in the vertical direction.

The above-mentioned four toner cartridges 36*a*-36*d* are accommodated inside the main body 1 under an upper cover 37.

Figure 9:
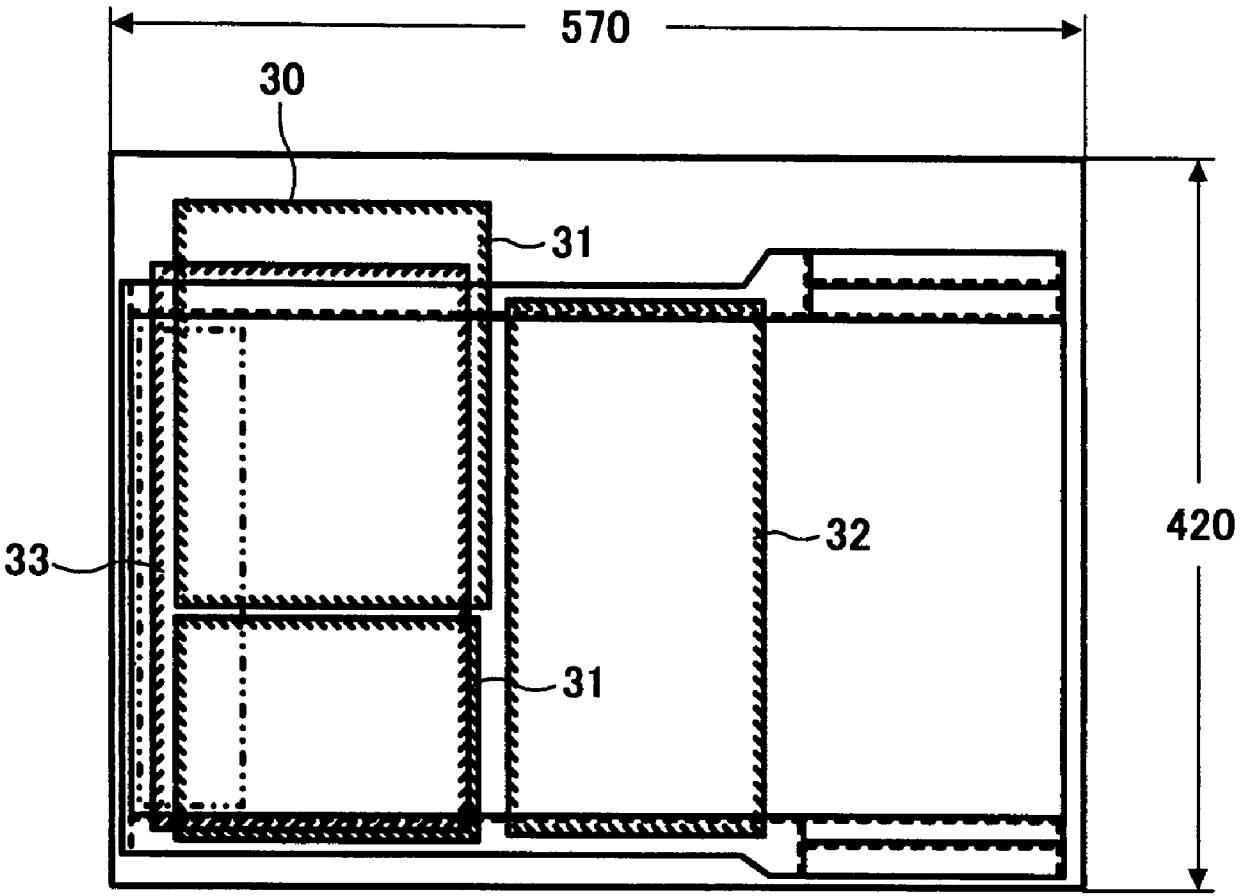
FIG. 9 is a top view of the color laser printer of FIG. 7.
Figure 10:
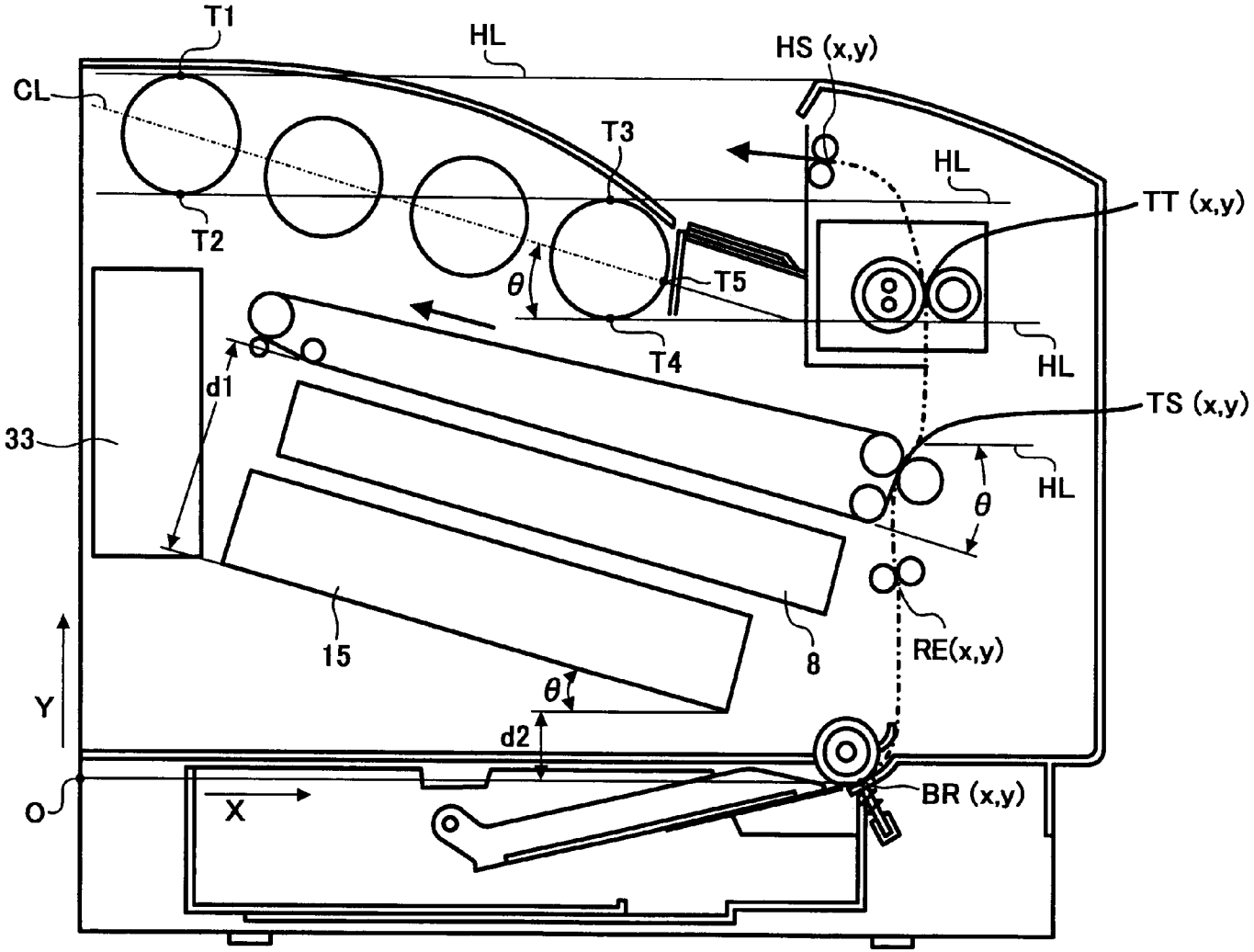
FIGS. 10-13 are schematic diagrams of the color laser printer of FIG. 7 indicating definitions of points, lengths, angles, and mathematical formulas associated with the layout of the color laser printer of FIG. 7.

FIG. 9 is a top plan view of the color laser printer 100, indicating that the width of the color laser printer 100 is 420.

In the color laser printer 100, the layout of the image forming station 3 is expressed by using mathematical formulas with the following definitions of points, lengths, angles, and so on for the associated components, as illustrated in FIGS. 10-13. In this discussion, X and Y represent horizontal and vertical directions, respectively, x and y represent variants in the directions X and Y, respectively, and O represents the origin of this X-Y coordination system, which is at the bottom and leftmost corner of the color laser printer 100 in the drawing. In addition, HL represents a horizontal line and CL represents a center line.

Further, HS(x,y) represents a sheet ejection point at which the recording sheets having full-color images are ejected by the pair of ejection rollers 23*a*. TT(x,y) represents a fixing point which is a center point of a fixing nip region formed in the fixing unit 22. TS(x,y) represents a secondary image transfer point at which the secondary image transfer is performed by the secondary transfer unit 20. RE(x,y) represents a registration point at which the registration is performed by the pair of the registration rollers 24. BR(x,y) represents a sheet separation point at which the recording sheet, yet having no image thereon, is separated from other recording sheets remaining in the sheet supply mechanism 2 and is transferred into the image forming station 3 through the sheet inlet 2*a*.

T1(x,y) represents the highest point of the highest positioned toner cartridge 36*a*. T2(x,y) represents the lowest point of the highest positioned toner cartridge 36*a*. T3(x,y) represents the highest point of the lowest positioned toner cartridge 36*d*. T4(x,y) represents the lowest point of the lowest positioned toner cartridge 36*d*. T5(x,y) represents a point of the toner cartridges 36*a*-36*d* having the shortest distance to the fixing point TT(x,y).

Also, various angles of lines in relation to the horizontal line HL are defined as follows. As described above, the character θ represents the angle of the moving image forming bed formed by the intermediate transfer belt 7 relative to the horizontal line HL. A character ϕ represents an angle of a line between the secondary image transfer point TS(x,y) and a point of the intermediate transfer belt 7 at which a side edge line of a unit of the four image forming mechanisms 8Y, 8C, 8M, and 8Bk, extended in a direction perpendicular to the intermediate transfer belt 7, intersects the intermediate transfer belt 7. A character γ represents an angle of a line formed between the secondary transfer point TS(x,y) and the sheet separation point BR(x,y) relative to the horizontal line HL. A character β represents an angle of a line formed between the fixing point TT(x,y) and the secondary image transfer point TS(x,y).

Various lengths are defined as follows. A term d1 represents a distance between the moving image forming bed of the intermediate transfer belt 7 and a bottom side of the optical writing unit 15, sandwiching the four image forming mechanisms 8Y, 8C, 8M, and 8Bk. A term d2 represents a vertical distance in the direction Y between the sheet separation point BR(x,y) and a bottom corner edge of the optical writing unit 15 closer to the sheet supply mechanism 2. A term d3 represents a distance between the secondary image transfer point TS(x,y) and the point of the intermediate transfer belt 7 at which the side edge line of the unit of the four image forming mechanisms 8Y, 8C, 8M, and 8Bk, extended in the direction perpendicular to the intermediate transfer belt 7, intersects the intermediate transfer belt 7.

A term D represents a vertical distance in the direction Y between the secondary image transfer point TS(x,y) and the sheet separation point BR(x,y). A term HI represents a distance between the point T5(x,y) and the fixing point TT(x,y), which is referred to as a toner fixation prevention distance. A term HIx represents a horizontal distance in the direction X between the point T5(x,y) and the fixing point TT(x,y), which is an element in the direction X of the toner fixation prevention distance. A term HIy represents a vertical distance in the direction Y between the point T5(x,y) and the fixing point TT(x,y), which is an element in the direction Y of the toner fixation prevention distance. A term h represents a distance between the fixing point TT(x,y) and the secondary image transfer point TS(x,y). A term N (see FIG. 12) represents a distance between the center points of the toner cartridge 36*a* for the Y color toner and the toner cartridge 36*d* for the Bk color toner. A term R1 represents a radius of each of the four toner cartridges 36*a*-36*d*. A term R2 (see FIG. 16) represents a radius of the toner cartridge 36*d* when the radius of the toner cartridge 36*d* is different from that of others.

Figure 12:
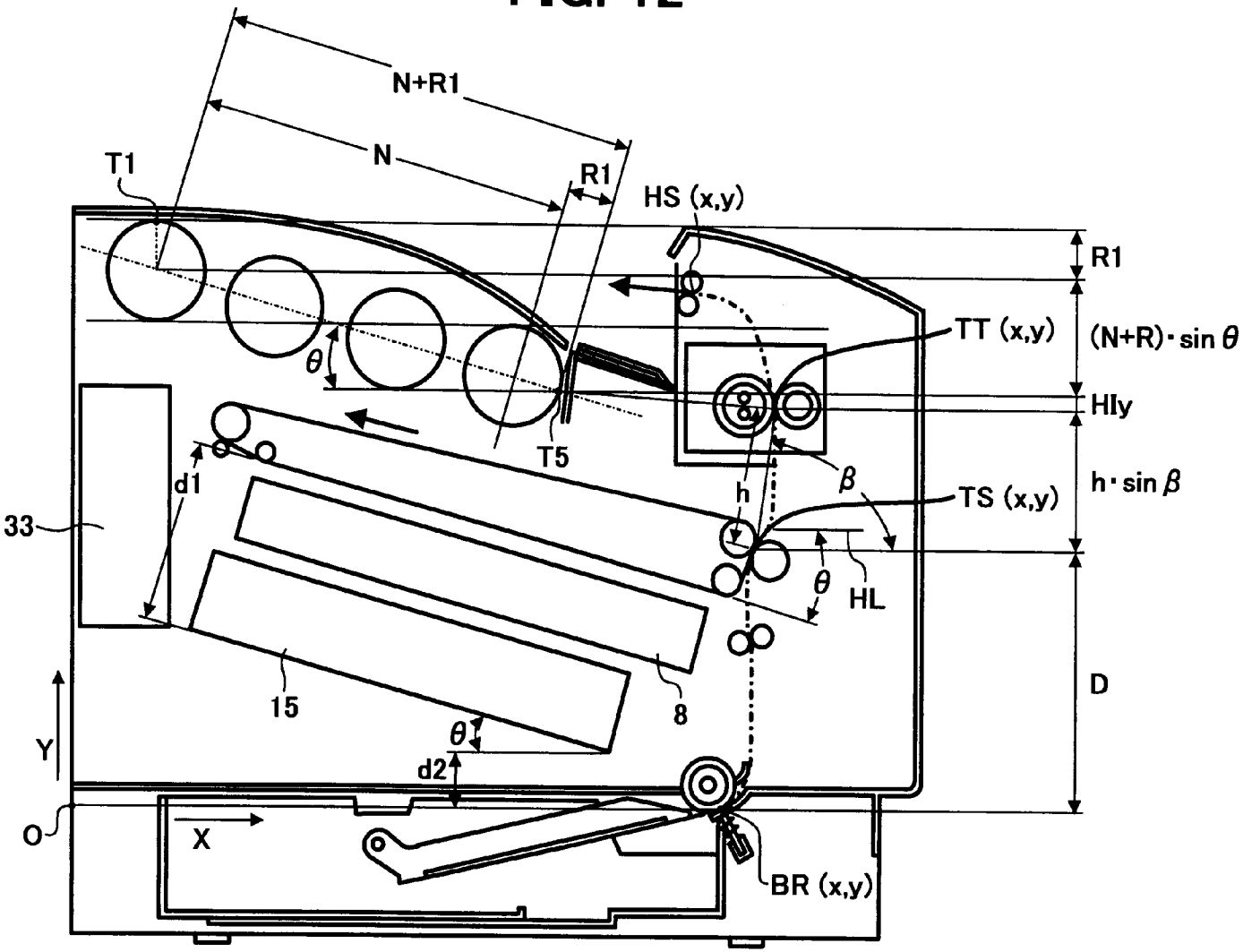

In the color laser printer 100, the toner cartridge 36*a* is arranged at the highest position among the essential components. With the above definitions, the value of the highest point T1 of the toner cartridge 36*a* variable in the direction Y is expressed, as shown in FIG. 12, by the following equation;

$$T1(y)=R1+(N+R1)\sin\theta+HIy+h\sin\theta+D.$$

In the right side of the above-mentioned equation, a block of the terms {R1+(N+R1)sin θ+HIy} represents a vertical distance in the direction Y between the highest point T1 of the toner cartridge 36*a* and the fixing point TT(x,y). The term h sin θ represents a vertical distance in the direction Y between the fixing point TT(x,y) and the secondary image transfer point TS(x,y). The term D represents, as defined above, the vertical distance in the direction Y between the secondary image transfer point TS(x,y) and the sheet separation point BR(x,y).

Figure 11:
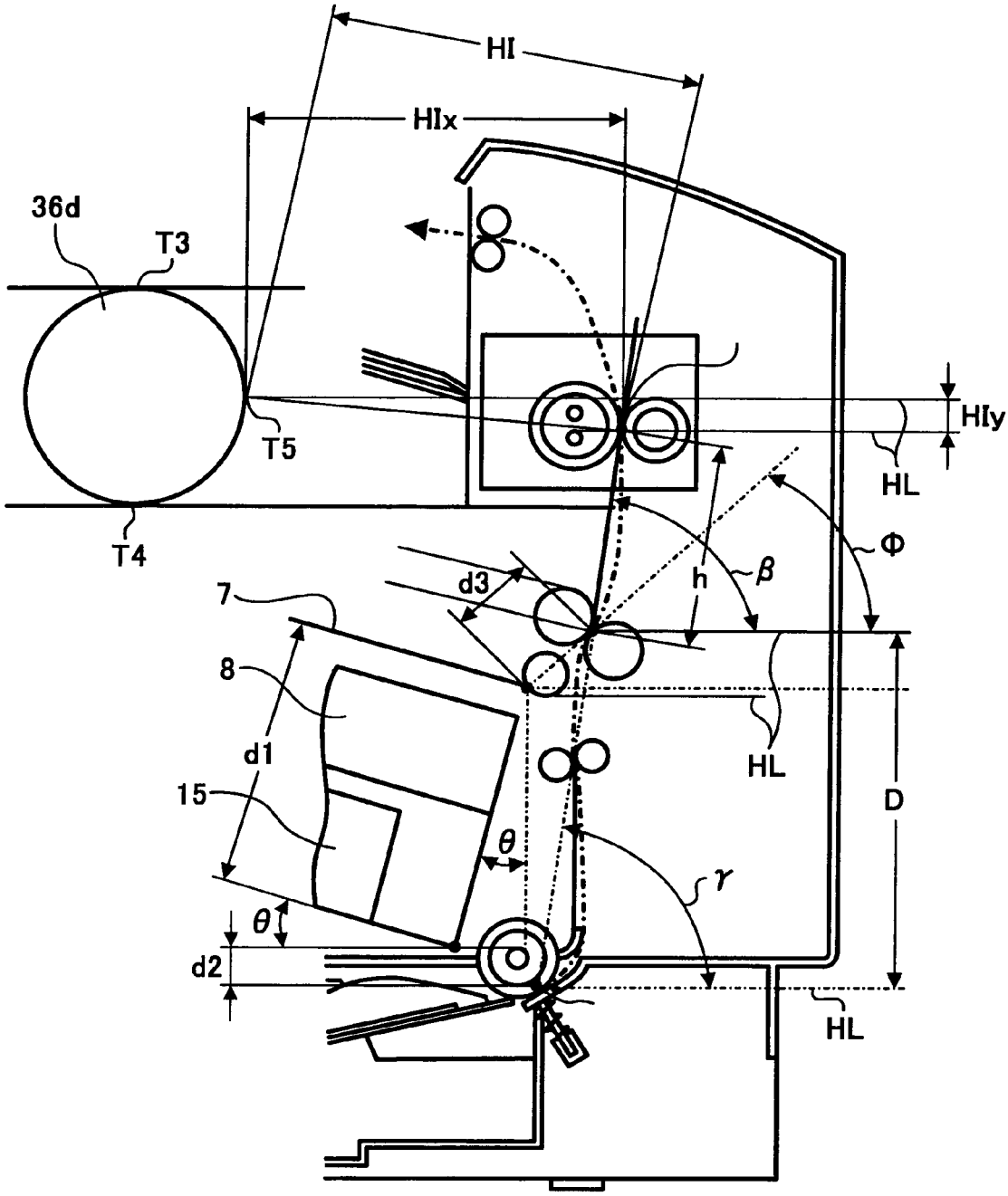

Here, the vertical distance D is expressed, as shown in FIG. 11, by the following equation;

$$D=d2+d1\cos\theta+d3\sin\phi.$$

Figure 13:
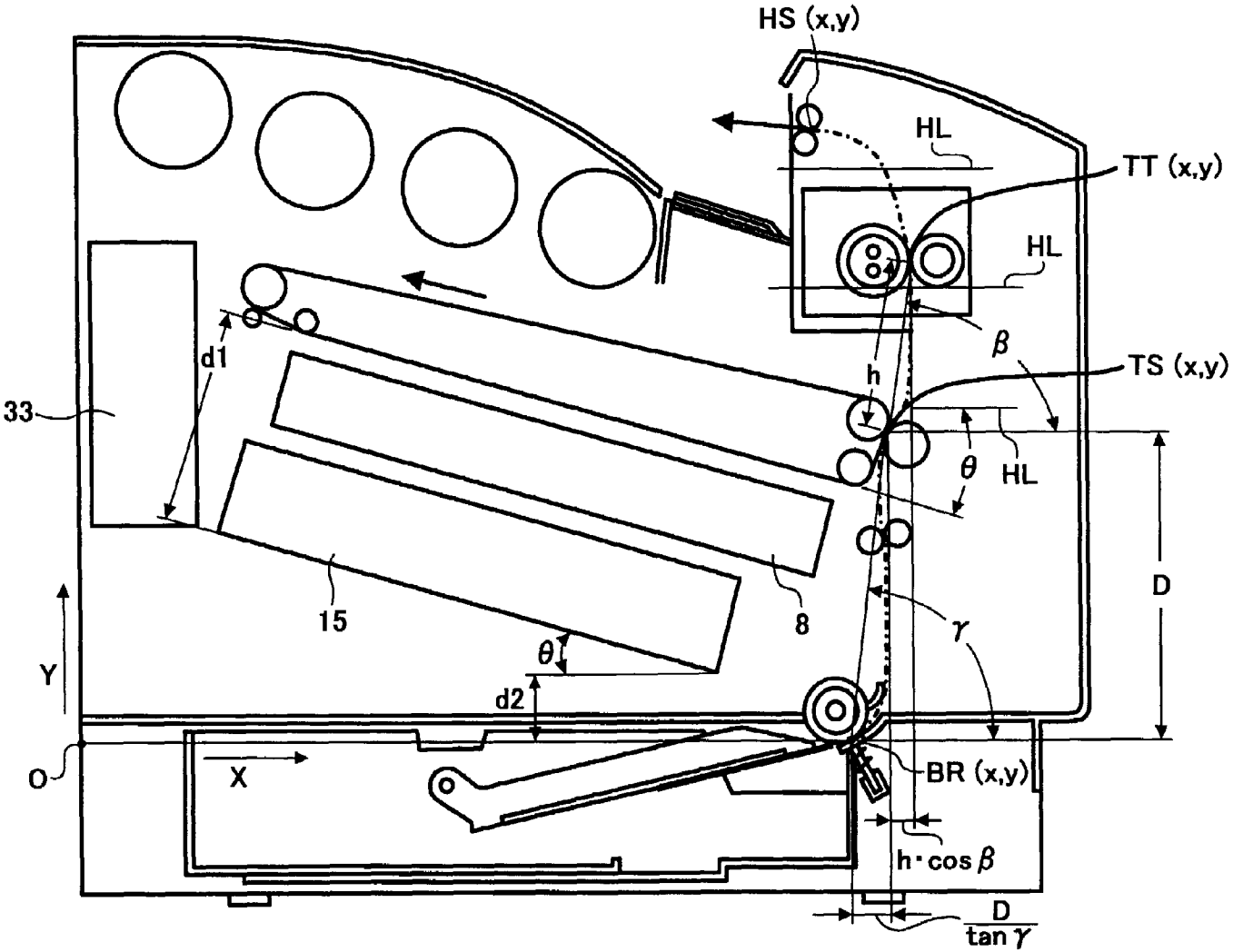

Further, in the color laser printer 100, since the fixing unit 22 is arranged at the rightmost position in the drawing and the fixing point TT(x,y) has the greatest value in the direction X, a horizontal greatest distance TT(x) of the fixing point TT(x) is expressed, as shown in FIG. 13, by the following equation;

$$TT(x)=BR(x)+D/\tan\gamma+h\cos\beta.$$

Based on the above equations, the color laser printer 100 preferably has the layout fulfilling a relationship T1(y)≦TT(x). In addition, the color laser printer 100 preferably has the layout fulfilling a relationship TT(y)≦T3(y) and more preferably the layout fulfilling a relationship T4(y)≦TT(y)≦T3(y). Further, the layout of the color laser printer 100 preferably fulfills a relationship HS(y)≦T1(y) and more preferably a relationship T2(y)≦TT(y)≦T3(y).

In addition, the angle θ formed between the moving image forming bed and the horizontal line fulfills the following equation;

$$\sin\theta=\{T1(y)-HIy-h\sin\beta-D-R1\}/(N+R1).$$

The thus-defined angle θ is preferably set to a value within the range of 5 degrees to 25 degrees.

Figure 5:
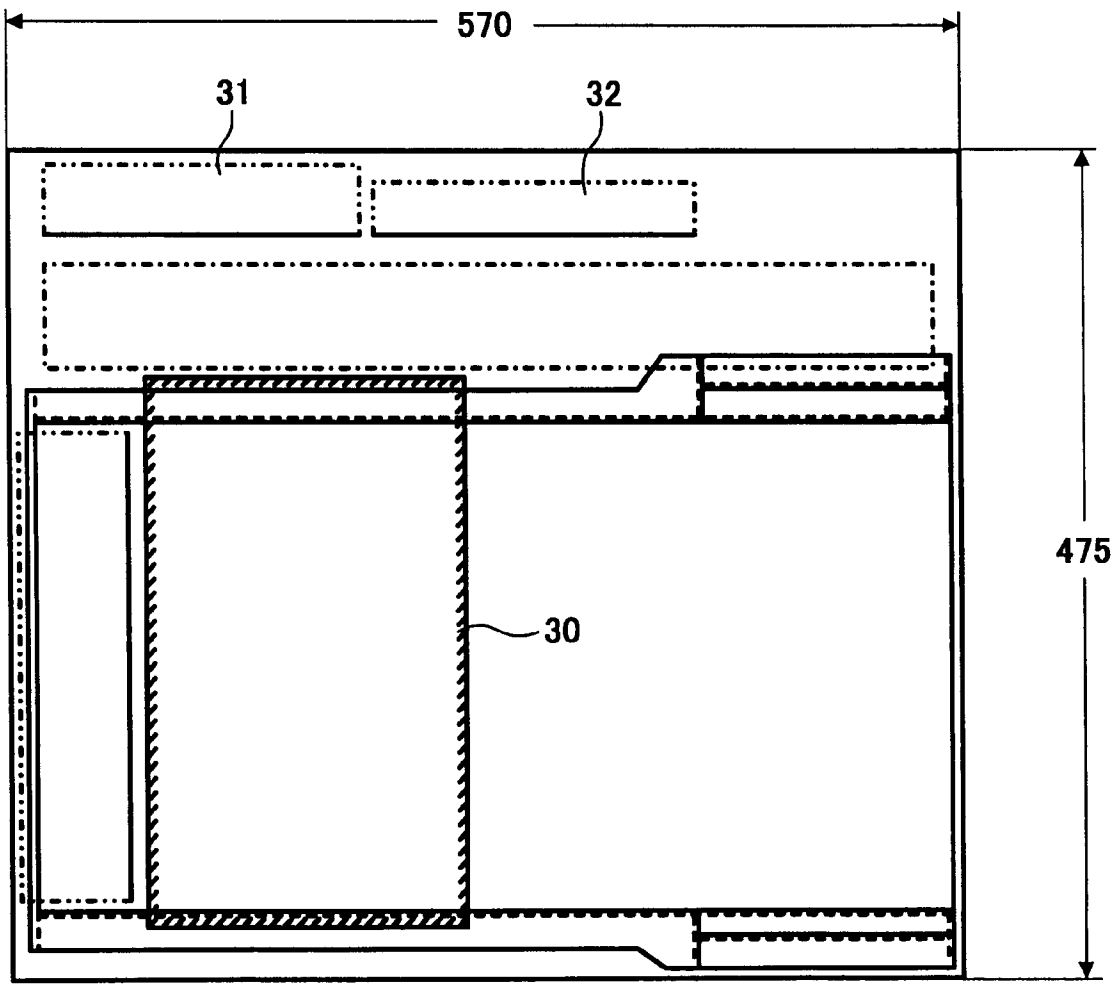
FIG. 5 PRIOR ART
FIG. 5 is a top view of the improved version of the background color image forming apparatus of FIG. 2.
Figure 6:
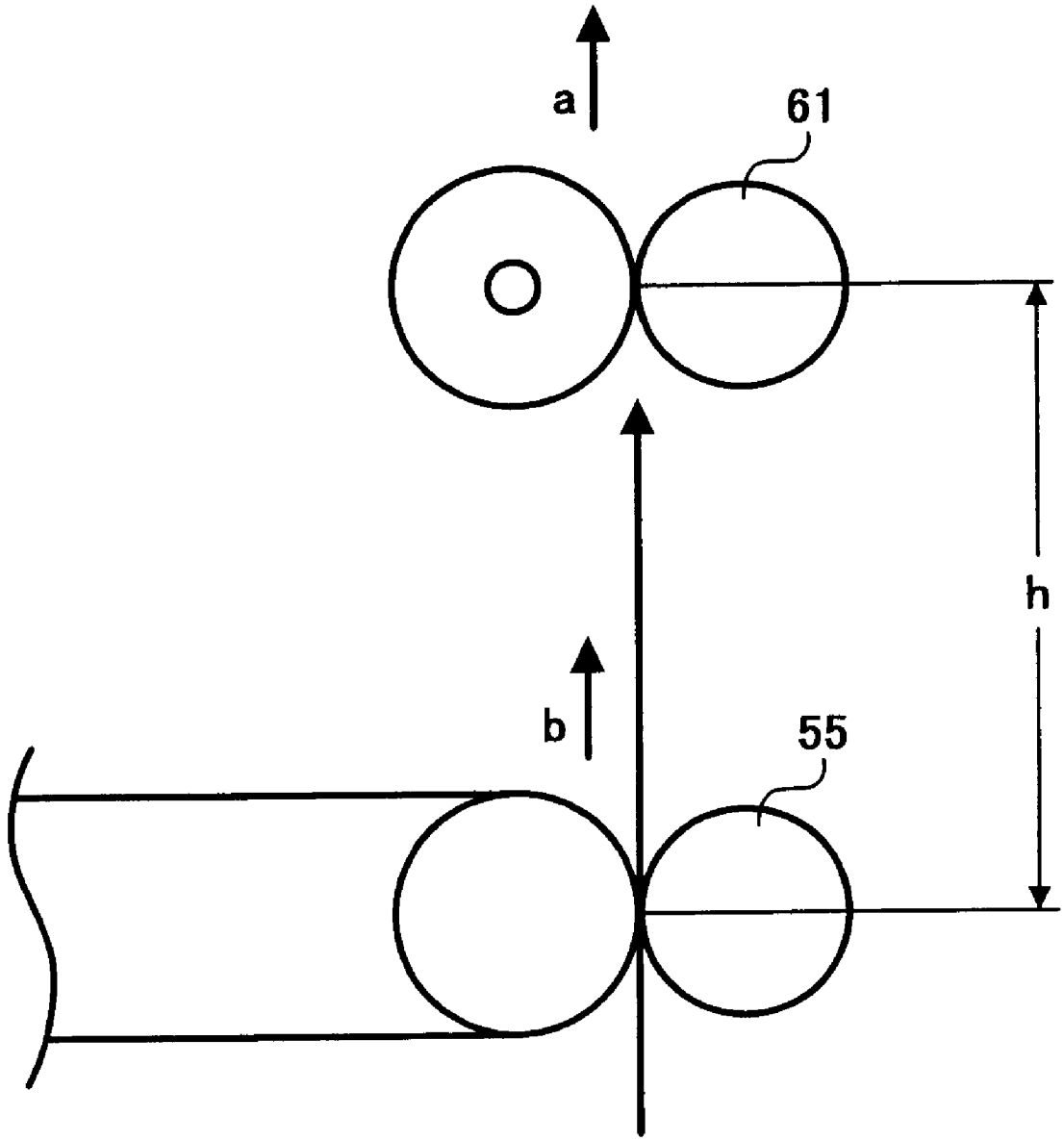
FIG. 6 PRIOR ART
FIG. 6 is an illustration for explaining a problem occurring in connection with a sheet conveyance between an image transfer point to a fixing point.

Next, a discussion is made for a comparison between the color laser printer 100 of FIG. 7 and the background image forming apparatus of FIG. 4. FIG. 9 is a top plan view of the color laser printer 100 of FIG. 7 and FIG. 5 is a top plan view of the background printer of FIG. 4. The components used in the color laser printer 100 of FIG. 7 are substantially equivalent to those of the image forming apparatus of FIG. 4.

Figure 8:
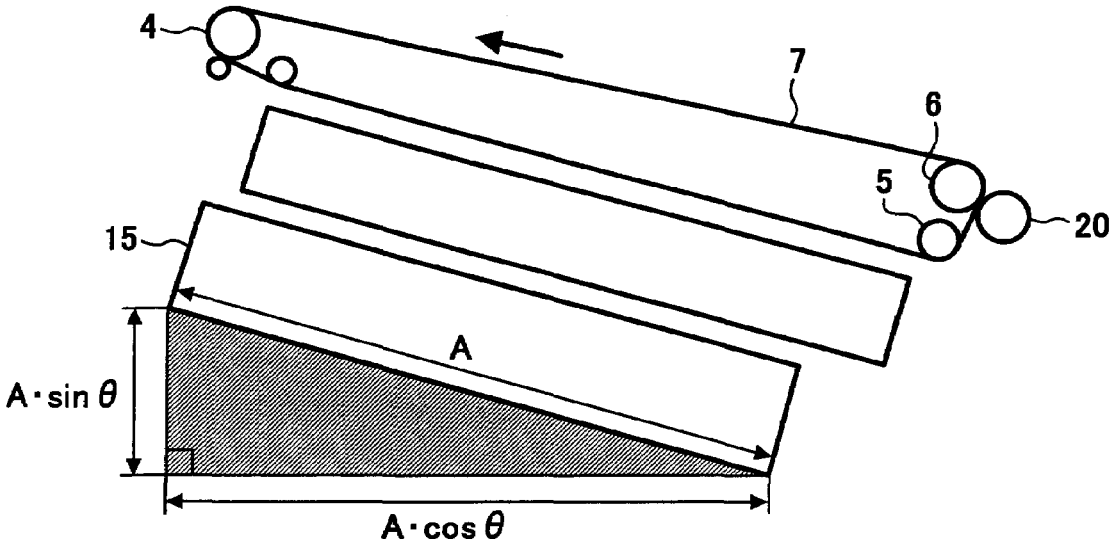
FIG. 8 is an illustration for explaining a space having a cross section of triangular shape formed underneath an optical writing unit tilted together with an intermediate transfer belt and an image forming mechanism.

It should be clear from the illustrations of FIGS. 7 and 8 and those of FIGS. 4 and 5 that, if the machine front side is positioned in the right sides in the drawings, the color laser printer 100 has the same length of 570 mm as the other, but a shorter width of 420 mm by 55 mm and a shorter height of 468 mm by 7 mm than the other. That is, the color laser printer 100 is successfully downsized. The differences are expressed by millimeters which look miniscule. However, since most of the techniques for downsizing the image forming apparatus presently available are used in full play, even a millimeter reduction means a successful and beneficial downsizing. In the color laser printer 100, the toners are consumable products and are replenished from the toner cartridges 36*a*-36*d* to the respective development units 12 of the image forming mechanisms 8Y, 8C, 8M, and 8Bk through corresponding toner replenishing mechanisms (not shown). The toner replenishing mechanisms use a toner conveying member such as an auger (not shown), for example, which is driven by a main motor (not shown). Based on this structure, as illustrated in FIG. 7, in the toner replenishing mechanisms, toner conveying passages between the respective toner cartridges 36*a*-36*d* to the corresponding development units 12 have substantially the same length and angle relative to the corresponding development units 12.

More specifically, each of the toner cartridges 36*a*-36*d* is arranged over the intermediate transfer belt 7, with the same angle θ as the tilt angle of the moving image forming bed of the intermediate transfer belt 7, and in parallel to the adjacent toner cartridge with substantially the same space as the space provided between adjacent two of the image forming mechanisms 8Y, 8C, 8M, and 8Bk.

With the above-described structure, preconditions for the conveyance of the color toners are almost evenly set among the four toner paths from the toner cartridges 36*a*-36*d* to the development units 12 of the image forming mechanisms 8Y, 8C, 8M, and 8Bk. This facilitates setting and controlling of the toner conveyance when the toner conveyance is operated with a single driving mechanism.

Figure 14:
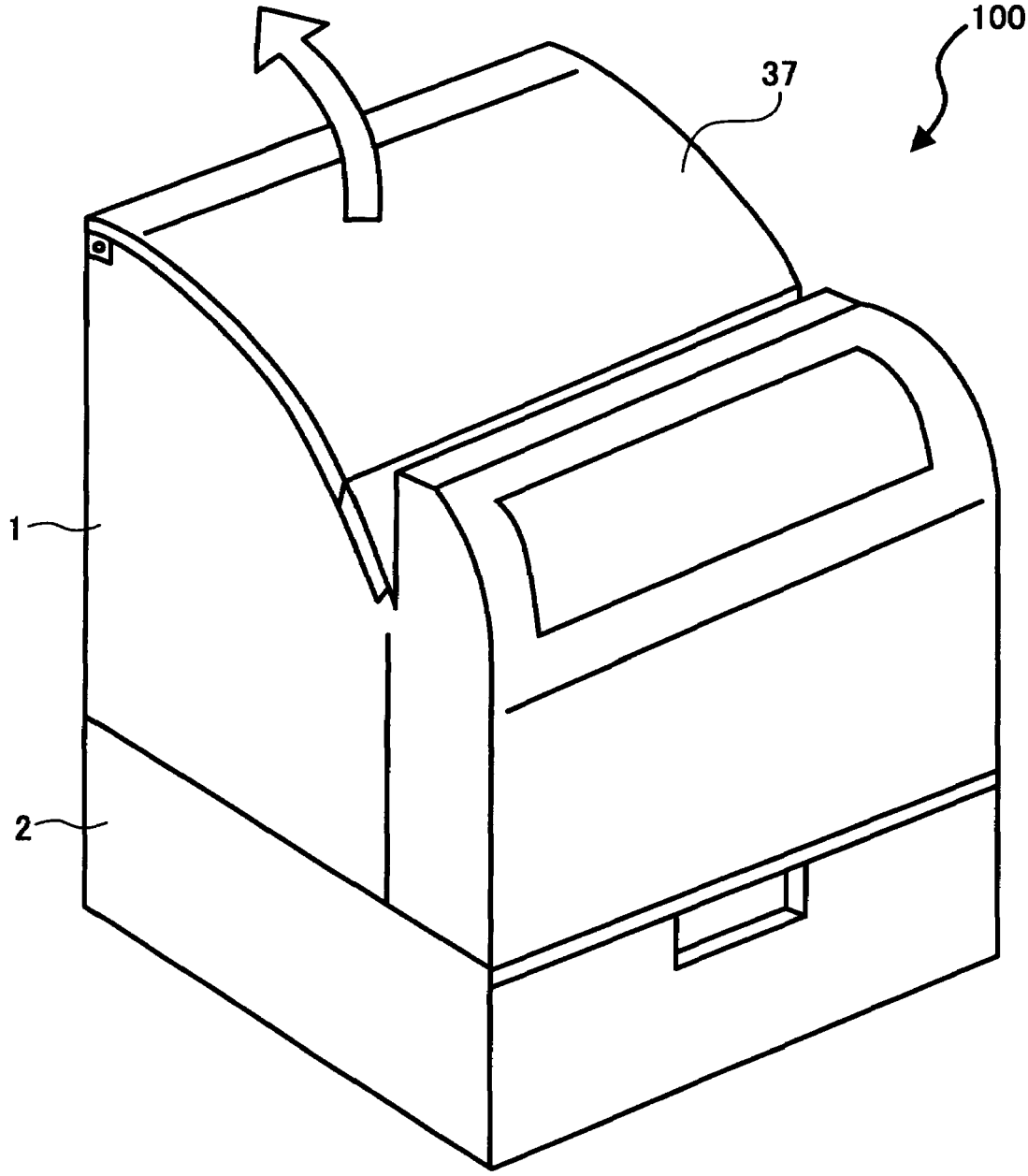
FIG. 14 is an illustration for showing an openable upper cover of the color laser printer of FIG. 7.

When one of the toner cartridges 36*a*-36*d* becomes empty, the cartridge needs to be exchanged with a new cartridge. Each of the toner cartridges 36*a*-36*d* is exchanged by lifting the upper cover 37 upward as indicated by an arrow in FIG. 14. When the upper cover 37 is lifted, the toner cartridges 36*a*-36*d* are almost equally accessible to the user since they are arranged with the predetermined angle θ. That is, for example, the toner cartridge 36*a* located at the rearmost position from the machine front is not less accessible because it is positioned at the highest horizontal level relative to others. This greatly increases operability of the toner exchanges and visual recognition, in comparison with the background image forming apparatus in which the four toner cartridges are aligned on a horizontal plain.

In addition, the above-described structure of the color laser printer 100 minimizes the total length of the sheet path from the sheet supply mechanism 2 to the ejection mechanism, and easily provides a substantially straight path from the registration roller 24 to the fixing unit 22. The straight path generally prevents a sheet jamming. Furthermore, the total sheet path can easily be accessed by opening the front cover of the color laser printer 100, so that when a sheet jamming occurs, the jammed sheet can easily be removed from the front side with the front cover opened.

Figure 15:
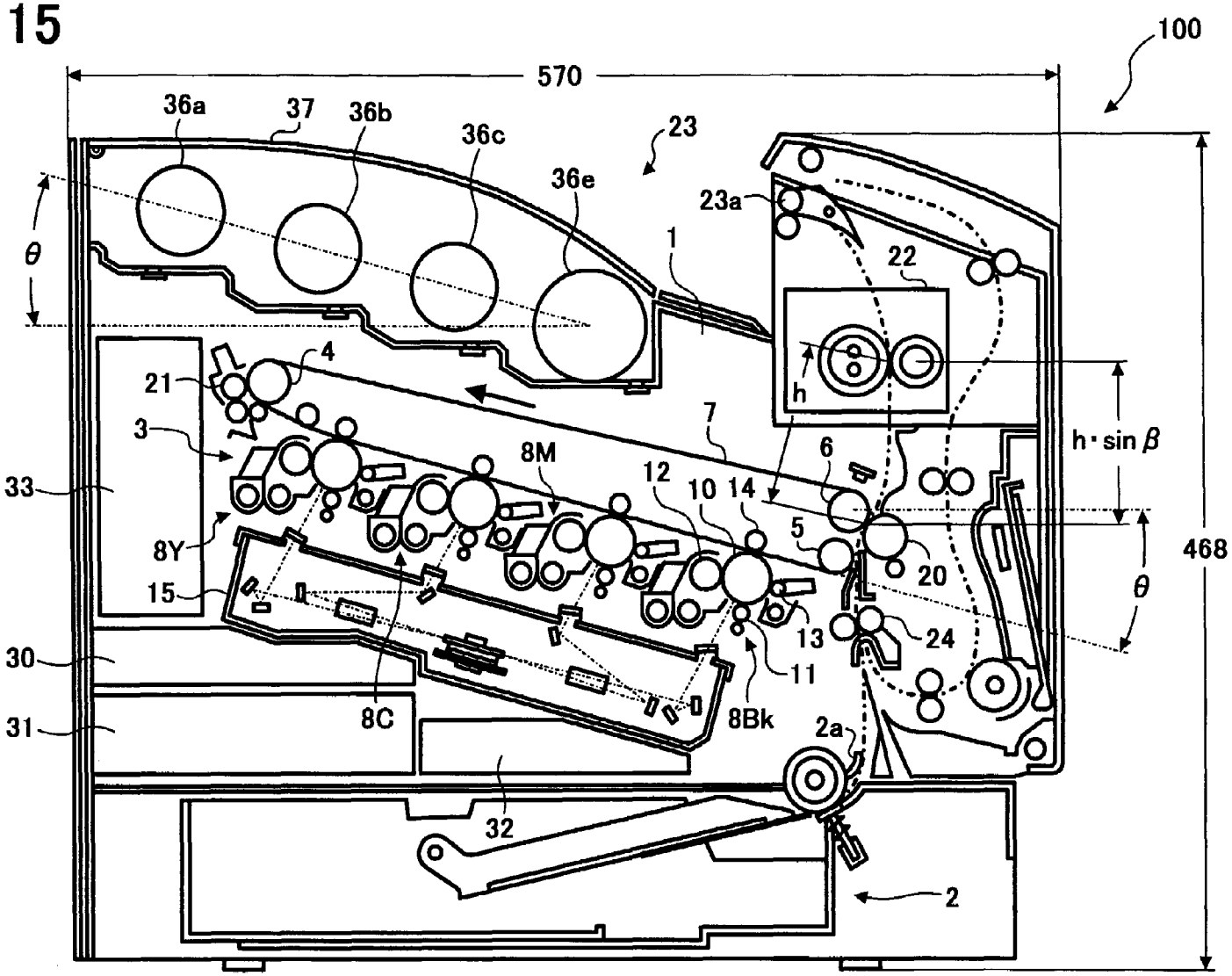
FIGS. 15 and 16 are schematic diagrams of a modified version of the color laser printer of FIG. 7 in which a toner cartridge 36*d* has a greater radius than others.
Figure 16:
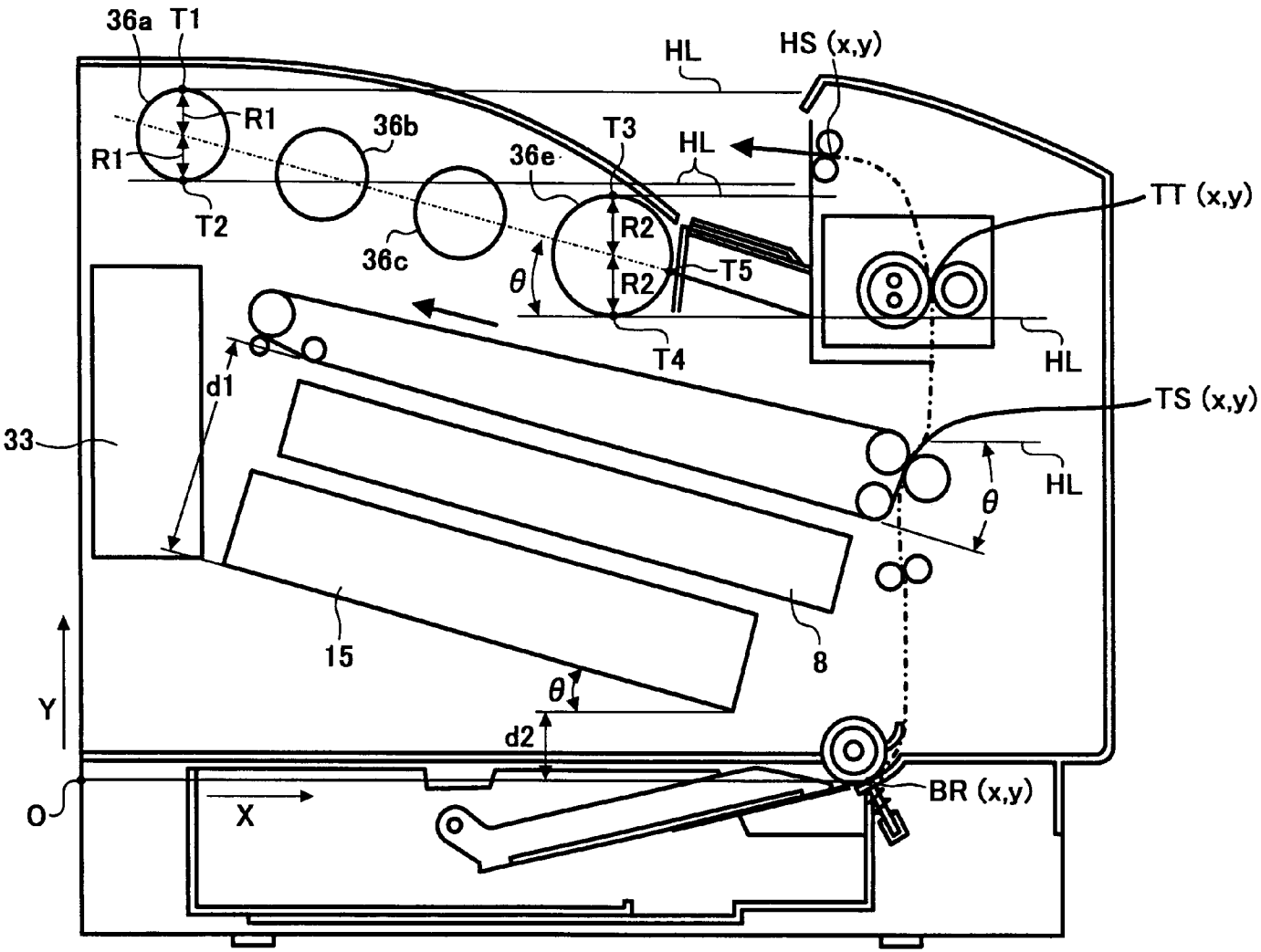

As an alternative, one or more toner cartridges can be made with a greater radius than others. For example, a toner cartridge 36*e* has a greater radius than the other toner cartridges 36*a*-36*c*, as illustrated in FIGS. 15 and 16. With this structure, the toner cartridge having a greater radius can contain a greater amount of toner than others and may be used for a most consumed toner, such as the black toner. As a result, a number of cartridge exchanges will be reduced.

Figure 17:
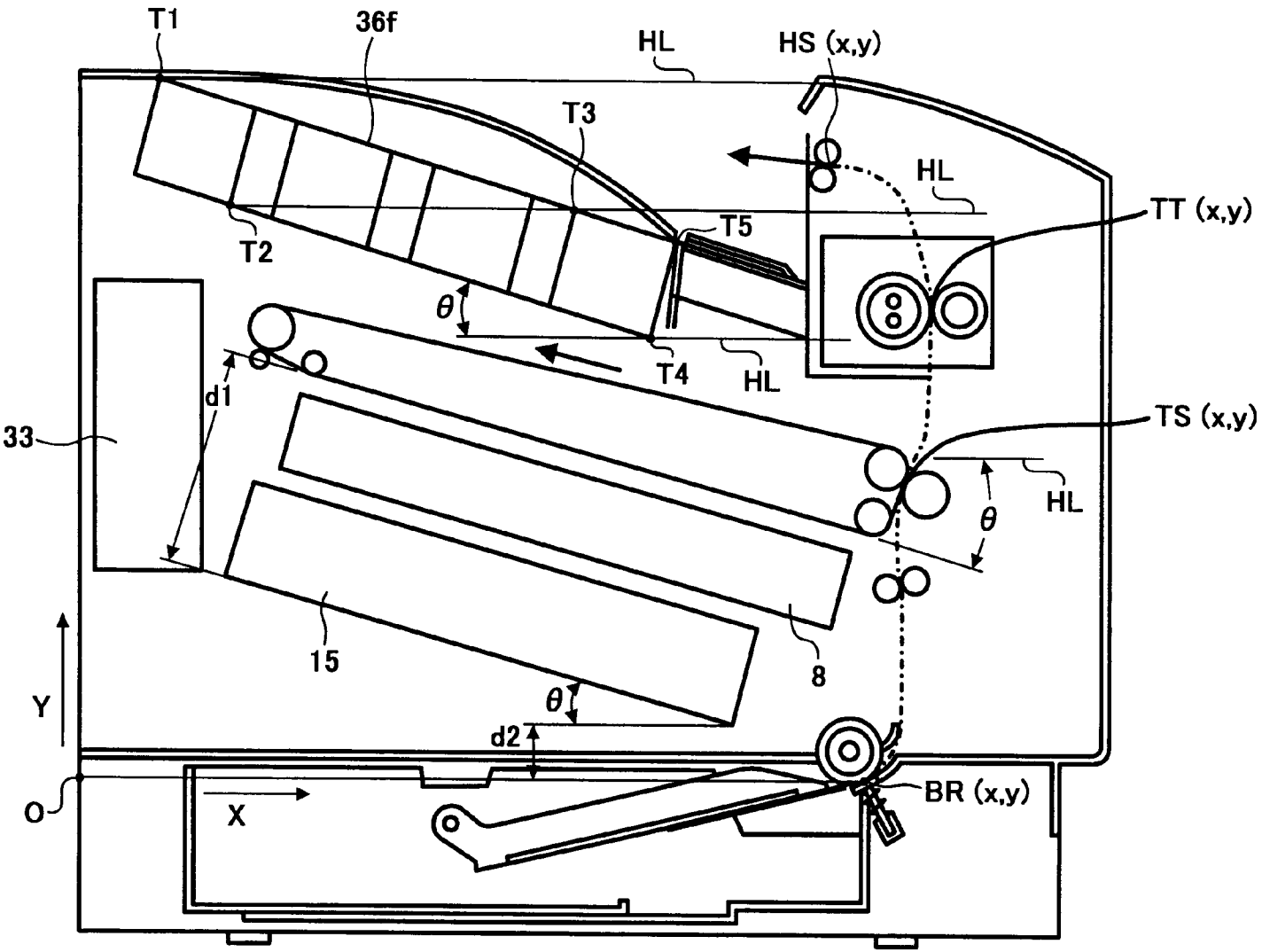
FIG. 17 is a schematic diagram of another modified version of the color laser printer of FIG. 7 in which toner cartridges 36*a*-36*d* have a prism shape.

In addition, the shape of the toner cartridges 36*a*-36*d* is not limited to a cylinder and can be of any shape, such as a prism shape. For example, toner cartridges 36*f* have a prism shape, as illustrated in FIG. 17.

Numerous additional modifications and variations are possible in light of the above teachings. It should therefore be understood that within the scope of the appended claims, the disclosure of this patent specification may be practiced otherwise than as specifically described herein.

What is claimed is:

1. An image forming apparatus, comprising:

an intermediate transfer belt extended under pressure by a first roller at a first side and by second and third rollers at a second side, and having an inclined surface with respect to the ground between the first roller and third roller;

a plurality of image forming units in contact with the inclined surface of the intermediate transfer belt and configured to form images; and an optical writing unit configured to emit at least one light beam, wherein the second roller is positioned above and at least partially overlapping the third roller.

2. The image forming apparatus according to claim 1, further comprising:

a secondary transfer roller arranged to face the second roller relative to the intermediate transfer belt, wherein the secondary transfer roller is disposed at least partially below the second roller and at least partially above the third roller.

3. The image forming apparatus according to claim 2, further comprising a fixing device disposed above the second and third rollers and the secondary transfer roller, wherein the image forming apparatus is configured to feed a sheet perpendicularly between the second roller and the secondary transfer roller in a direction away from the center of the image forming apparatus and then feed the sheet through the fixing device in a direction towards the center of the image forming apparatus.

4. The image forming apparatus according to claim 2, wherein the second roller is at least partially overlapping the secondary transfer roller in the vertical direction.

5. The image forming apparatus according to claim 1, wherein the optical writing unit is inclined with respect to the ground and is disposed below and in parallel with the surface of the intermediate transfer belt.

6. The image forming apparatus according to claim 1, further comprising:

a sheet supply storage cartridge disposed below the optical writing unit.

7. The image forming apparatus according to claim 6, further comprising:

a part of an electrical component disposed below the optical writing unit and above the sheet supply storage cartridge.

8. The image forming apparatus according to claim 1, further comprising:

a part of an electrical component disposed outside and in front of the upper end of the intermediate transfer belt.

9. The image forming apparatus according to claim 1, wherein the image forming unit includes a photosensitive drum, a charging unit, a development unit and a cleaning unit.

* * * * *